US006555951B2

(12) United States Patent
Jeoung

(10) Patent No.: US 6,555,951 B2
(45) Date of Patent: Apr. 29, 2003

(54) FLAT COLOR CRT

(75) Inventor: Seoung Han Jeoung, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/987,381

(22) Filed: Nov. 14, 2001

(65) Prior Publication Data

US 2002/0130607 A1 Sep. 19, 2002

(30) Foreign Application Priority Data

Jan. 17, 2001 (KR) ..... 2001-2585

(51) Int. Cl.[7] ..... H01J 29/07

(52) U.S. Cl. ..... 313/408; 313/461; 313/402; 313/403

(58) Field of Search ..... 313/408, 440, 313/477 R, 403, 402

(56) References Cited

U.S. PATENT DOCUMENTS 6,087,767 A * 7/2000 Sano et al. ..... 313/440

* cited by examiner

*Primary Examiner*—Vip Patel
*Assistant Examiner*—Ken A Berck
(74) *Attorney, Agent, or Firm*—Fleshner & Kim, LLP

(57) ABSTRACT

Color CRT having a rectangular panel with an outer surface with a radius of curvature greater than 30,000 mm, an inner surface with a fixed curvature, and a skirt extended substantially perpendicular to the inner and outer surfaces, and a funnel connected to a skirt seal edge part of the panel, to meet conditions of $0.18 \leqq OAH/(USD/2) \leqq 0.29$, where USD denotes a diagonal effective screen size of the panel, OAH denotes a distance from a center of an outer surface to an extension plane of a skirt seal edge part, OMH denotes a distance from an outer surface molded match line of the panel to the skirt seal edge part, and OSH denotes a distance from the outer surface molded match line of the panel to a skirt brake line, thereby reducing a panel weight compared to the same size of tube for the same effective screen size, that reduces weights of components, resulting to reduce a flat CRT weight in overall, and reduces thermal breakage in a furnace, by adjusting correlations of OAH, OMH, and OSH of an outer surface of a panel.

16 Claims, 7 Drawing Sheets

$y=0.4607x+126.05$
$R^2=0.959$ $y=0.4528x+77.224$
$R^2=0.9569$ $y=0.4576x+106.52$
$R^2=0.9582$ $y=0.4509x+65.018$
$R^2=0.9564$ $y=0.4548x+89.429$
$R^2=0.9575$ $y=0.4489x+52.812$
$R^2=0.9559$

FLAT COLOR CRT

BACKGROUND OF THE INVENTION

1. Field of the Invention

The present invention relates to a flat color CRT, and more particularly, to a flat color CRT (Cathode Ray Tube), in which a flat panel structure is improved, for reducing breakage in a furnace during heat treatment and a weight thereof, to provide a flat color CRT having a weight lighter than CRTs of the same kind, a lower cost, and a shorter tube axis.

2. Background of the Related Art

FIG. 1 illustrates a section a related art color CRT schematically, provided with a panel 1, front glass, welded to a funnel 2, a rear glass, a fluorescent film on an inside surface of the panel 1 for emitting a light, an electron gun which is a source of electron beams 11 for emitting the fluorescent film, a shadow mask 3 for selecting a color so that a desired fluorescent film emits a light, and a main frame 5 for supporting the shadow mask 3.

There are springs 6 for fastening the main frame 5 having the shadow mask 3 fitted thereto to the panel, and an inner shield 7 fixed to the main frame 5 for shielding the CRT from an influence of an external geomagnetism, both of which are enclosed under a high vacuum.

The operation principle of the color CRT in FIG. 1 will be explained. The electron beams 11 emitted from the electron gun built in the funnel 2 are landed on the fluorescent film surface formed on an inside surface of the panel 1 by an anodic voltage applied to the CRT, when the electron beams are deflected in an up, down, left, or right direction, to form a picture.

Since the CRT is at a high vacuum, susceptible to implosion by an external impact, the panel 1 is designed to sustain the atmospheric pressure. Also, the panel 1 is strapped with a reinforcing band 12 at an outer surface of a skirt, for spreading stress to the CRT under the high vacuum, to secure an anti-impact performance.

The related art CRT is provided with the panel 1 and the funnel 2, with the electron gun inserted in a neck part of the funnel 2, which are sealed by evacuation. Under the high vacuum, a substantial tensile, or compression force is exerted on the panel 1 and the funnel 2, to cause an excessive tensile stress at a particular position of a screen of the panel 1.

Currently, it is a trend that the panel 1 is fabricated larger and flatter. FIGS. 2A and 2B respectively illustrate a form of the panel having curves at inside/outside surfaces thereof, and having almost no curve at an outside surface thereof, with a thicker, and heavier panel to cost higher and unfavorable as components, such as the panel, become larger.

FIG. 3 illustrates a flat type panel having no curvature at an outer surface thereof on the left, and a no flat type panel having curvatures at inside and outside surfaces thereof on the right, wherefrom it can be known that the flat type panel has a distance OMH from a molded match line to a seal edge line greater than the same of the no flat type on the right. Thus, the greater overall thickness of the related art flat type panel causes the panel to exceed a critical stress due to a difference of thermal expansion between inside and outside surfaces thereof coming from thermal conduction in a furnace.

SUMMARY OF THE INVENTION

Accordingly, the present invention is directed to a flat color CRT that substantially obviates one or more of the problems due to limitations and disadvantages of the related art.

An object of the present invention is to provide a flat color CRT, in which a structure of a panel is improved for reducing a ratio of damage of the color CRT in a furnace, and providing a lighter color CRT.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the color CRT having a rectangular panel with an outer surface with a radius of curvature greater than 30,000 mm, an inner surface with a fixed curvature, and a skirt extended substantially perpendicular to the inner and outer surfaces, and a funnel connected to a skirt seal edge part of the panel, to meet conditions of $0.18 \leqq OAH/(USD/2) \leqq 0.29$, where USD denotes a diagonal effective screen size of the panel, OAH denotes a distance from a center of an outer surface to an extension plane of a skirt seal edge part, OMH denotes a distance from an outer surface molded match line of the panel to the skirt seal edge part, and OSH denotes a distance from the outer surface molded match line of the panel to a skirt brake line, thereby reducing a panel weight compared to the same size of tube for the same effective screen size, that reduces weights of components, resulting to reduce a flat CRT weight in overall, and reduces thermal breakage in a furnace, by adjusting correlations of OAH, OMH, and OSH of an outer surface of a panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
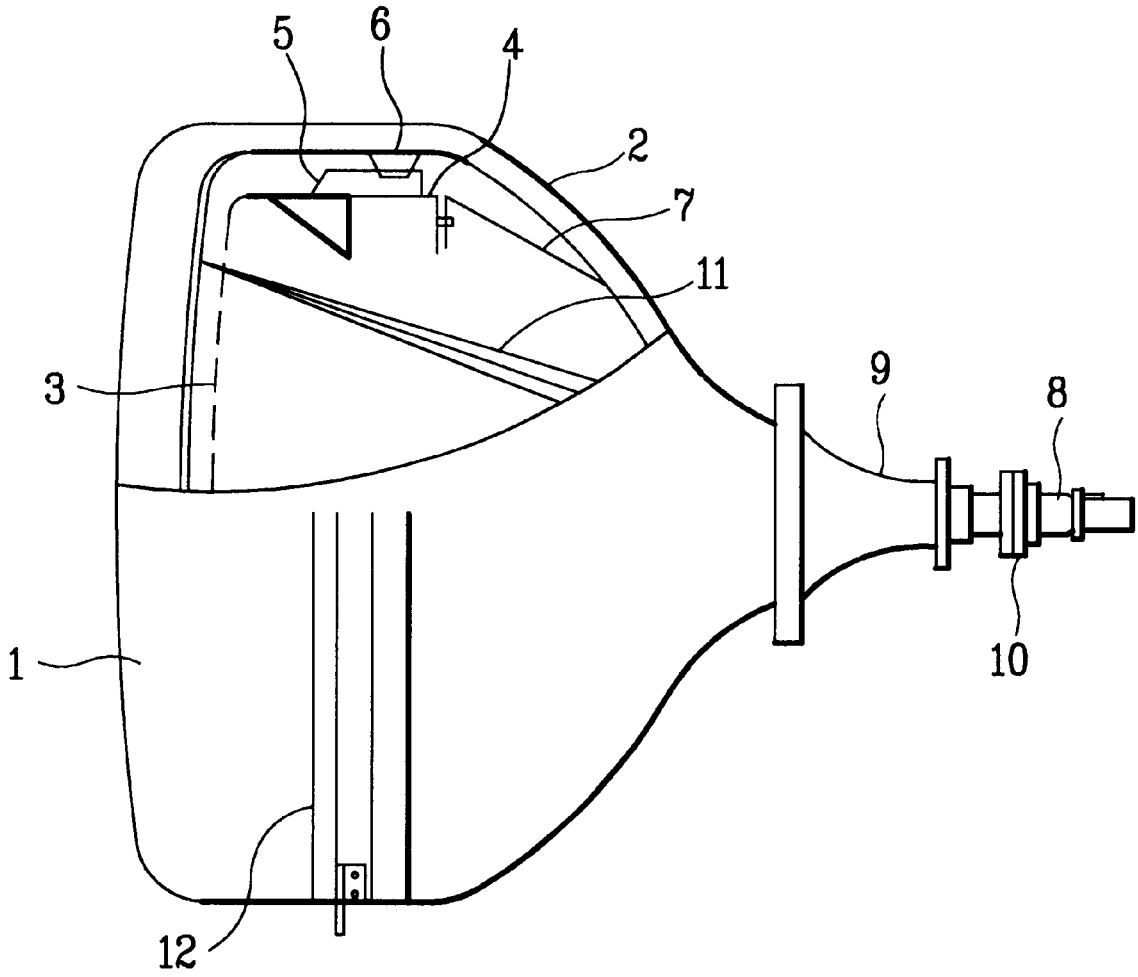
FIG.1 Related Art
FIG. 1 illustrates a section of a related art color CRT, schematically.
Figure 2A:
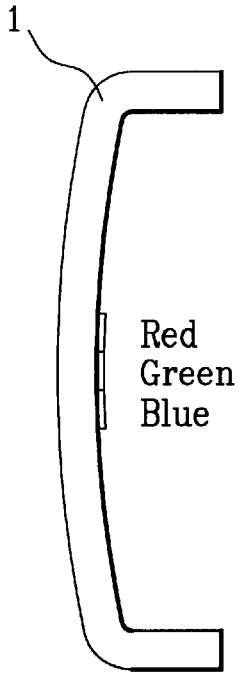
FIG.2A Related Art
FIGS. 2A and 2B illustrate sections of a panel having an outer curvature and a flat panel having almost no curvature, respectively.
Figure 2B:
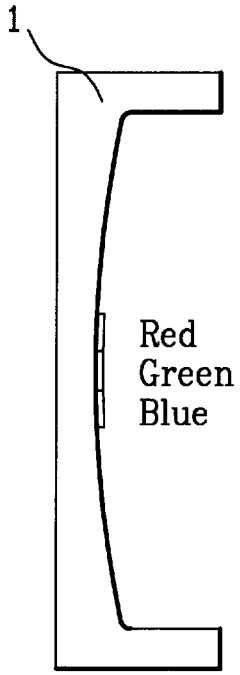
FIG.2B Related Art
Figure 3:
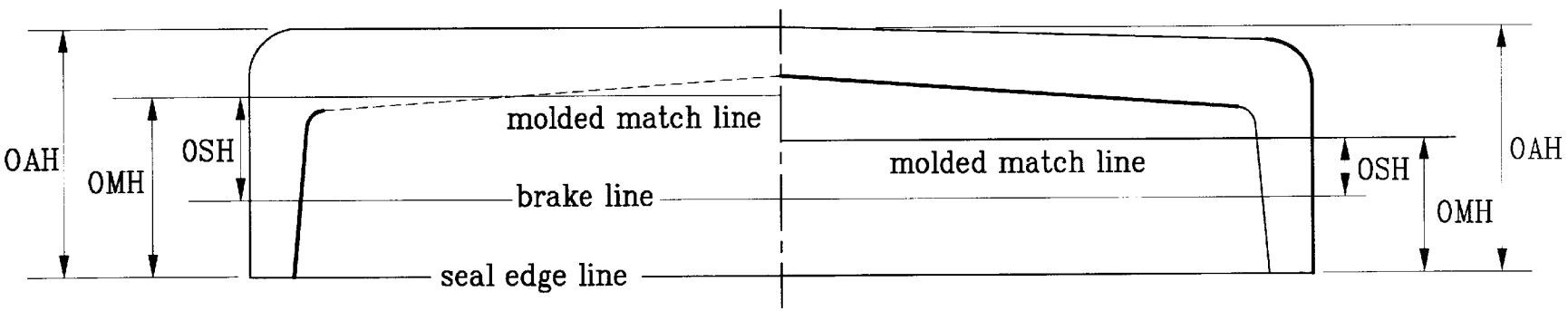
FIG.3 Related Art
FIG. 3 illustrates structures of skirt parts of a flat type panel and a curved panel, respectively.

In order to achieve the object of the present invention, the present invention suggests to fabricate a color CRT having a rectangular panel with an outer surface with a radius of curvature greater than 30,000 mm, an inner surface with a fixed curvature, and a skirt extended substantially perpendicular to the inner and outer surfaces, and a funnel connected to a skirt seal edge part of the panel, to meet conditions of 0.18≦OAH/(USD/2)≦0.29, or preferably conditions of 0.23≦OAH/(USD/2)≦0.27, where USD denotes a diagonal effective screen size of the panel, OAH denotes a distance from a center of an outer surface to an extension plane of a skirt seal edge part, OMH denotes a distance from an outer surface molded match line of the panel to the skirt seal edge part, and OSH denotes a distance from the outer surface molded match line of the panel to a skirt brake line.

In order to achieve the object of the present invention, the present invention suggests to fabricate a color CRT having a rectangular panel with an outer surface with almost no curvature, an inner surface with a fixed curvature, and a skirt extended substantially perpendicular to the inner and outer surfaces, and a funnel connected to a skirt seal edge part of the panel, to meet conditions of 0.11≦OMH/(USD/2)≦0.22, or preferably conditions of 0.12≦OMH/(USD/2)≦0.19 where USD denotes a diagonal effective screen size of the panel, and OMH denotes a distance from an outer surface molded match line of the panel to the skirt seal edge part, and to meet conditions of 0.08≦OSH/(USD/2)≦0.14, or preferably conditions of 0.09≦OSH/(USD/2)≦0.12, where USD denotes a diagonal effective screen size of the panel, and OSH denotes a distance from the outer surface molded match line of the panel to a skirt brake line.

In order to achieve the object of the present invention, the present invention suggests to fabricate a color CRT having a rectangular panel with a substantially flat outer surface, an inner surface with a fixed curvature, and a skirt extended substantially perpendicular to the inner and outer surfaces, and a funnel connected to a skirt seal edge part of the panel, to meet conditions of (OAH*1000)/(USD/2) is less than 0.457x+106.52, or preferably less than 0.4548x+89.429 and greater than 0.4509x+65.018, or less than 0.4509x+65.018 and greater than 0.4489x+52.812, where a diagonal effective screen size of the panel USD is 'x' (mm), and OAH denotes a distance from a center of an outer surface to an extension plane of a skirt seal edge part, and to meet conditions of 4.1≦(OAH*UST)/(USD/2)≦9.0, or preferably conditions of 5.26≦(OAH*UST)/(USD/2)≦8.14, where UST(Useful Screen Thickness) denotes a thickness at a diagonal end of the effective screen of the panel.

Preferred embodiments of the present invention will be explained with reference to the attached drawings.

As shown in a table 1 below, since a related art flat CRT design is done in view of common use of the related art flat CRT with the related art curved CRT, the related art flat CRT and the related art curved CRT become to have the same distance OAH from the outer center to a plane extended from the skirt seal edge, leading the related art flat CRT to have a relatively long OMH as the outer surface is almost flat in view of flat CRT, and very thick corner as the inner surface is curved, that result in an increased weight of the panel of the related art flat CRT by 1.26–1.48 times as shown in table 2, to increase, for an example, more than approx. 7 Kg in a case of a certain large sized CRT.

TABLE 1

| Design values | OAH/(USD/2) | OMH/(USD/2) | OSH/(USD/2) |
|---|---|---|---|
| Related art curved CRT | 0.30–0.35 | 0.15–0.21 | 0.06–0.11 |
| Related art flat CRT | 0.30–0.36 | 0.22–0.30 | 0.14–0.20 |

TABLE 2

| CRT size | Model | Weight (Kg) |
|---|---|---|
| 25" | Model 1 | 11.3 |
| | Model 2 | 11.6 |
| | FCD | 14.2 |
| 28" W | Model 1 | 14.2 |
| | Model 2 | 14.2 |
| | FCD | 18.7 |
| 29" | Model 1 | 16.2 |
| | Model 2 | 18.5 |
| | FCD | 23.9 |
| 32" W | Model 1 | 20.5 |
| | Model 2 | 23.1 |
| | FCD | 27.1 |

Figure 4A:
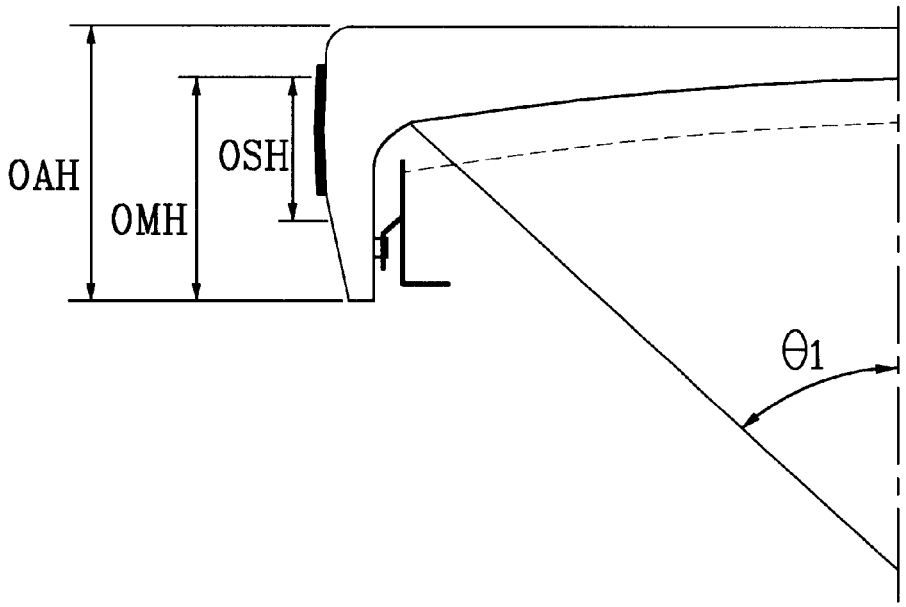
FIG. 4A Related Art
FIGS. 4A and 4B illustrate a related art panel, and a panel improved according to the present invention, respectively.
Figure 4B:
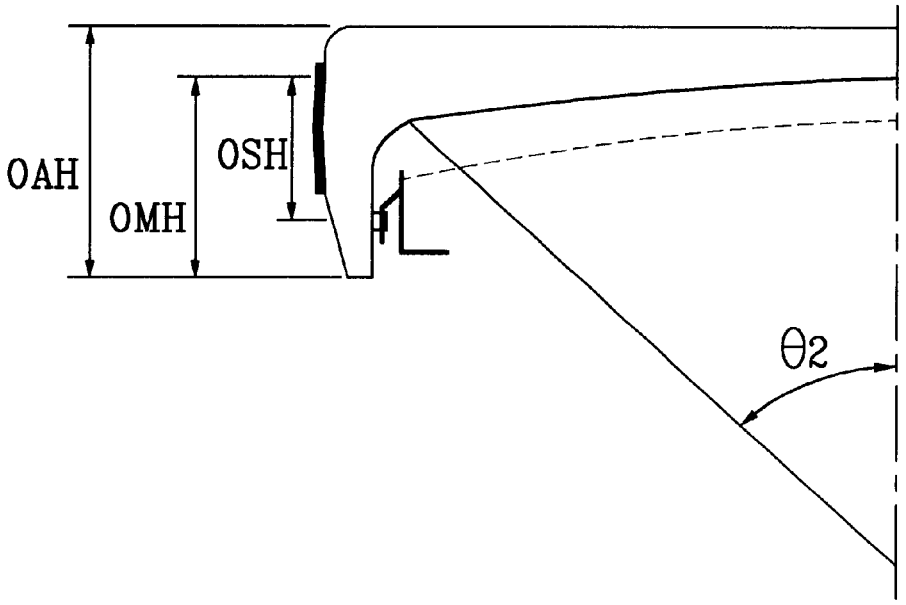
Figure 6:
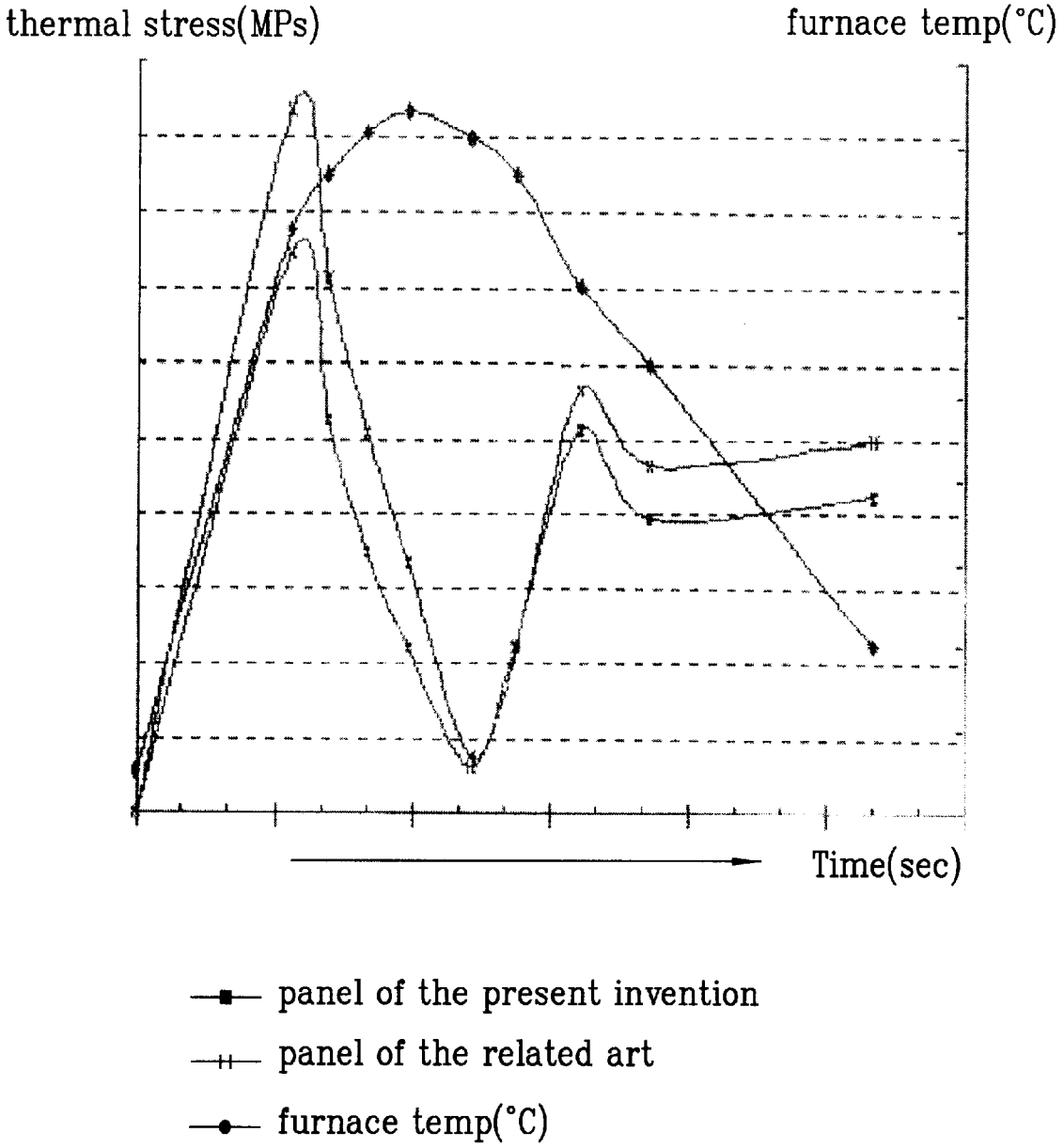
FIG. 6 illustrates a graph showing a result of thermal stress experiment of the related art panel and a panel of the present invention; and, FIG. 7 illustrates a graph showing a breakage ratio of a thickness at a diagonal end of effective screen of the panel vs. a maximum vacuum stress.

Referring to FIG. 4B, for solving this problem, a CFT and a panel height OAH are made shorter, for reducing the weight of the related art FCD panel, thereby improving a productivity of a panel manufacturer, dropping a panel cost as less glass is used, and reducing an overall length of the CRT as the length becomes shorter in comparison to the related art flat CRT. Also, the shorter skirt reduces band, frame. With regard to the thermal breakage in a furnace, known as a major problem in the related art flat CRT, much improvement can be expected, as a thermal conduction of the panel is improved as shown in FIG. 6.

Embodiment 1

A color CRT is fabricated to meet conditions of 0.1 8≦OAH/(USD/2)≦0.29, or preferably conditions of 0.23≦OAH/(USD/2)≦0.27, where USD denotes a diagonal effective screen size of the panel, OAH denotes a distance from a center of an outer surface to an extension plane of a skirt seal edge part, OMH denotes a distance from an outer surface molded match line of the panel to the skirt seal edge part, and OSH denotes a distance from the outer surface molded match line of the panel to a skirt brake line.

If OAH/(USD/2)≦0.18, the present technology can not satisfy other characteristics, such as a power consumption and deterioration of picture quality caused by a large angle deflection, and if 0.30≦OAH/(USD/2), there is almost no improvement over the related art flat CRT.

The conditions of 0.23≦OAH/(USD/2)≦0.27 are an optimum range in which the related art DY and electron gun are applicable as they are. As shown in FIGS. 4A and 4B, an excessively smaller OAH/(USD/2) shortens an overall length of the CRT relatively, that requires a greater deflection angle (form θ1 to θ2) to require re-design of the DY or the electron gun.

For using a production line of the CRT of the present invention interchangeable with an existing production line without great changes of components owing to a shortened length of the panel skirt part, conditions of 0.11≦OMH/(USD/2)≦0.22, or preferably conditions of 0.12≦OMH/(USD/2)≦0.19, and conditions of 0.08≦OSH/(USD/2)≦0.14, or preferably conditions of 0.09≦OSH/(USD/2)≦0.12, are met, where OMH denotes a distance from an outer surface molded match line of the panel to a skirt seal edge part, USD denotes a diagonal effective screen size of the panel, and OSH denotes a distance from the outer surface molded match line of the panel to a skirt brake line.

Thus,

Embodiment 2

A CDT of a size below 22" used as a high definition display for computer terminal and the like is mostly used at a deflection angle 90° or a wide angle below 100°, sensitive to changes of a panel skirt length, and the deflection angle, and designed at conditions of (OAH*1000)/(USD/2) to be less than 0.457x+106.52, where a diagonal effective screen size of the panel USD is 'x'(mm), and OAH denotes a distance from a center of an outer surface to an extension plane of a skirt seal edge part, for reduction of weight, shortening an overall length, reduction of thermal breakage of the panel, and securing an appropriate quality.

Figure 5:
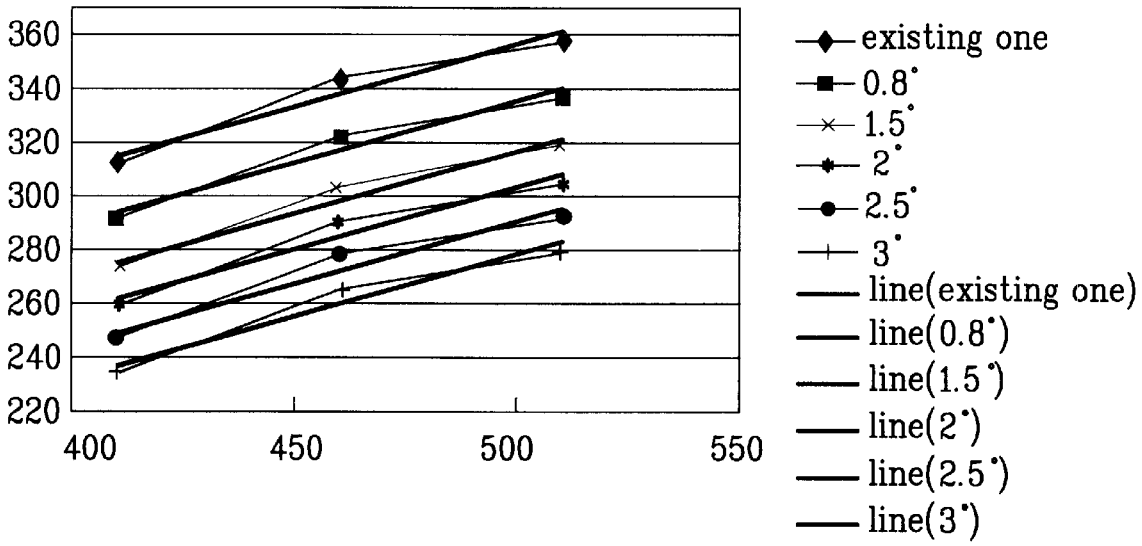
FIG. 5 illustrates a graph showing an effective screen area of a panel and a skirt of panel.

FIG. 5 illustrates a graph showing a diagonal effective screen size of a panel vs. (OAH* 1000)/(USD/2), wherein variations of the deflection angle according to reductions of a skirt length are shown at angles of the present one, 0.8°, 1°, 1.5°, 2°, 2.5°, and 3°. If (OAH*1000)/(USD/2) is less than 0.4548x+89.429 and greater than 0.4509x+65.018, i.e., if an increase of deflection angle caused by a reduction of the skirt part is set to be 1.5°–2.5°, the a light weighted CRT can be provided and the thermal breakage of the panel can be reduced while design changes of components (DY, frame, and electron gun) are minimized.

Of course, in a case (OAH*1000)/(USD/2) is greater than 0.4576x+106.52, even if an increase of the deflection angle caused by reduction of the skirt part is set to be less than 0.8°, the present electron gun, frame, mask, DY, and the like are applicable almost without changes, though effects of the tube weight reduction, material cost reduction, shortening an overall length, and thermal breakage reduction are somewhat slight.

If (OAH*1000)/(USD/2) is less than 0.4509x+65.018 and greater than 0.4489x+52.812, i.e., if an incremental deflection angle is set to be 2.5–3°, though the electron gun, the frame, the mask, the DY, and the like are required to be changed, the greatest amount of tube weight reduction, material cost reduction, shortening of an overall length, and thermal breakage reduction can be expected.

A design according to the first or second embodiment can reduce breakage coming from a thermal conduction difference of the panel in a furnace, and a panel weight as well as production cost as the length of skirt is substantially reduced in comparison to the related art skirt. FIG. 6 illustrates a result of thermal stress experimental of a 29" FCD panel designed to the first or second embodiment, and the related art panel, wherefrom it can be known that thermal stress of the panel of the present invention is reduced in overall compared to the related art panel. Thus, the panel of the present invention can reduce breakage compared to the related art panel.

Table 3 compares lengths of skirts of the related art and the present invention, wherefrom it can be known that the length of skirt of the present invention is reduced substantially compared to the related art.

TABLE 3

| | | Related art | The present invention FCD | | | | | |
|---|---|---|---|---|---|---|---|---|
| Effective screen size | | FCD OAH(mm) | 0.8° OAH | 1° OAH | 1.5° OAH | 2° OAH | 2.5° OAH | 3° OAH |
| 15"FCD | 360 (mm) | 65 | 61 | 60 | 58 | 56 | 52 | 51 |
| 17"FCD | 410 | 64 | 60 | 59 | 56 | 53 | 51 | 48 |
| 19"FCD | 460 | 79 | 74 | 73 | 70 | 67 | 64 | 61 |
| 21"FCD | 510 | 91 | 88 | 84 | 81 | 78 | 74 | 71 |
| 25"FCD | 590 | 90 | 84 | 82 | 78 | 74 | 70 | 66 |
| 28"WFCD | 660 | 104 | 97 | 95 | 90 | 85 | 80 | 75 |
| 29"FCD | 676 | 112 | 104 | 102 | 98 | 93 | 88 | 83 |
| 32"FCD | 756 | 114 | 105 | 103 | 97 | 92 | 86 | 81 |

If the length of the skirt part is reduced according to the first or second embodiment, and design the panel to meet conditions of 4.1≦(OAH*UST)/(USD/2)≦9.0, where UST (Useful Screen Thickness) denotes a thickness of an effective screen of the panel at a diagonal end thereof, thermal breakage in a furnace and a vacuum stress can be reduced.

Figure 7:
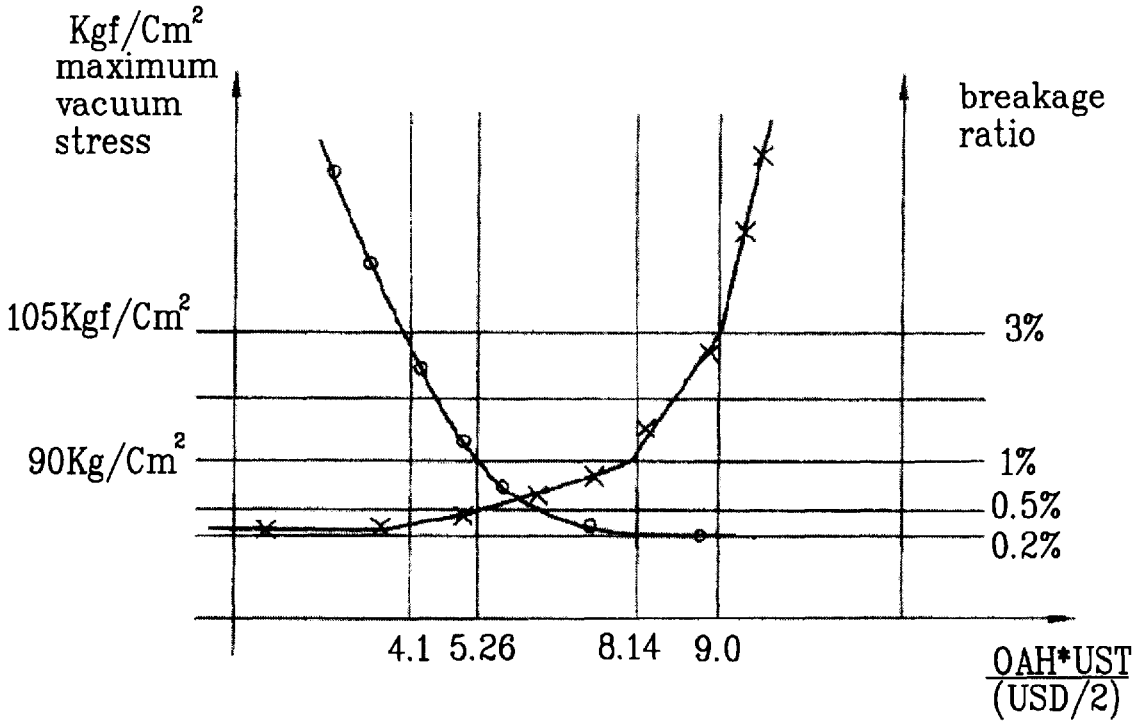

FIG. 7 illustrates a graph showing a thermal breakage ratio of a thickness, i.e., (OAH*UST)/(USD/2), at a diagonal end of effective screen of the panel vs. a vacuum stress, wherefrom it can be known that, if (OAH*UST)/(USD/2) is below 4.1, while the breakage ratio becomes constant at approx. 0.2%, the vacuum stress exceeds 105 Kgf/cm$^2$, to cause problem, and if (OAH*UST)/(USD/2) is greater than 9, while the vacuum stress can be lowered, the breakage ratio increases sharply greater than 3%. If (OAH*UST)/(USD/2) is in a range between 5.26–8.14, preferably, the maximum vacuum stress can be maintained below 90 Kgf/cm$^2$ while the breakage ratio can be maintained below 1%.

By adjusting correlations of OAH, OMH, and OSH of an outer surface of a panel, the present invention reduces a panel weight compared to the same size of tube for the same effective screen size, that reduces weights of components, resulting to reduce a flat CRT weight in overall, and reduces thermal breakage in a furnace.

It will be apparent to those skilled in the art that various modifications and variations can be made in the flat color CRT of the present invention without departing from the spirit or scope of the invention. Thus, it is intended that the present invention cover the modifications and variations of this invention provided they come within the scope of the appended claims and their equivalents.

What is claimed is:

1. A flat color CRT comprising:

a rectangular panel including a substantially flat outer surface, an inner surface having a fixed curvature, and a skirt extended substantially perpendicular from the outer and inner surfaces; and, a funnel connected to a skirt seal edge part of the panel, wherein 0.18≦OAH/(USD/2)≦0.29 is met, where USD denotes a diagonal effective screen size of the panel, and OAH denotes a distance from an outer surface center to a plane extended from a skirt seal edge part.

2. A flat color CRT as claimed in claim 1, wherein 0.23≦OAH/(USD/2)≦0.27 is met.

3. A flat color CRT as claimed in claim 1, wherein 0.08≦OSH/(USD/2)≦0.14 is met, where USD denotes a diagonal effective screen size, and OSH denotes a distance from an outer surface molded match line of the panel to a brake line.

4. A flat color CRT as claimed in claim 1, wherein 4.1≦(OAH*UST)/(USD/2)≦9.0 is met, where UST (Useful Screen Thickness) denotes a thickness of the effective screen surface of the panel at a diagonal end thereof.

5. A flat color CRT comprising:

a rectangular panel including a substantially flat outer surface, an inner surface having a fixed curvature, and a skirt extended substantially perpendicular from the outer and inner surfaces; and, a funnel connected to a skirt seal edge part of the panel, wherein $0.11 \leqq OMH/(USD/2) \leqq 0.22$ is met, where USD denotes a diagonal effective screen size of the panel, and OMH denotes a distance from an outer surface molded match line to a skirt seal edge part.

6. A flat color CRT as claimed in claim 5, wherein $0.11 \leqq OMH/(USD/2) \leqq 0.22$ is met.

7. A flat color CRT as claimed in claim 5, wherein $0.08 \leqq OSH/(USD/2) \leqq 0.14$ is met, where USD denotes a diagonal effective screen size, and OSH denotes a distance from an outer surface molded match line of the panel to a brake line.

8. A flat color CRT as claimed in claim 7, wherein $0.09 \leqq OSH/(USD/2) \leqq 0.12$ is met.

9. A flat color CRT as claimed in claim 5, wherein $4.1 \leqq (OAH*UST)/(USD/2) \leqq 9.0$ is met, where UST (Useful Screen Thickness) denotes a thickness of an effective screen of the panel at a diagonal end thereof.

10. A flat color CRT comprising:

a rectangular panel including a substantially flat outer surface, an inner surface having a fixed curvature, and a skirt extended substantially perpendicular from the outer and inner surfaces; and, a funnel connected to a skirt seal edge part of the panel, wherein $(OAH*1000)/(USD/2)$ is smaller than $0.4567x+106.52$, where OAH denotes a distance from an outer surface center to a plane extended from a skirt seal edge part, and 'x(mm)' denotes a diagonal effective screen size of the panel.

11. A flat color CRT as claimed in claim 10, wherein $(OAH*1000)/(USD/2)$ is smaller than $0.4548x+89.429$, and greater than $0.4509x+65.018$.

12. A flat color CRT as claimed in claim 10, wherein $(OAH*1000)/(USD/2)$ is smaller than $0.4509x+65.018$, and greater than $0.4489x+52.812$.

13. A flat color CRT as claimed in claim 10, wherein $4.1 \leqq (OAH*UST)/(USD/2) \leqq 9.0$ is met, where UST (Useful Screen Thickness) denotes a thickness of an effective screen of the panel at a diagonal end thereof.

14. A flat color CRT as claimed in claim 4, wherein $5.26 \leqq (OAH*UST)/(USD/2) \leqq 8.14$ is met.

15. A flat color CRT as claimed in claim 9, wherein $5.26 \leqq (OAH*UST)/(USD/2) \leqq 8.14$ is met.

16. A flat color CRT as claimed in claim 13, wherein $5.26 \leqq (OAH*UST)/(USD/2) \leqq 8.14$ is met.

* * * * *